United States Patent [19]

Scaggs

[11] 4,440,536

[45] Apr. 3, 1984

[54] METHOD AND DEVICE FOR POSITIONING AND GUIDING PIPE IN A DRILLING DERRICK

[76] Inventor: Orville C. Scaggs, P.O. Box 430, Lindsey, Okla. 73052

[21] Appl. No.: 258,933

[22] Filed: Apr. 30, 1981

Related U.S. Application Data

[63] Continuation-in-part of Ser. No. 42,001, May 24, 1979, Pat. No. 4,274,777, and Ser. No. 931,150, Aug. 4, 1978, abandoned.

[51] Int. Cl.[3] ..... E21B 19/14

[52] U.S. Cl. ..... 414/22; 414/745; 414/786; 166/85; 175/85

[58] Field of Search ..... 414/22, 745, 786, 910; 175/52, 85; 166/77.5, 85

[56] References Cited

U.S. PATENT DOCUMENTS 1,900,921 3/1933 Endsley ..... 414/22
2,692,059 10/1954 Bolling ..... 414/22
2,828,024 3/1958 True ..... 414/22
4,172,684 10/1979 Jenkins ..... 414/22

*Primary Examiner*—Leslie J. Paperner
*Assistant Examiner*—Ken Muncy
*Attorney, Agent, or Firm*—Chris H. Morgan

[57] ABSTRACT

A method and device for positioning and guiding pipe, including coupling and uncoupling pipe, in a drilling derrick having a work table for securing pipe extending into the well. The upper end of a first pipe section is received and horizontally secured by a mechanical arm attached to the derrick pipe so that the upper end of the first section is disposed above a second pipe section secured in the work table. In uncoupling the first pipe section is unthreaded and raised prior to releasing it from the mechanical arm. In coupling, the first pipe section is lowered and coupled to the second pipe section prior to releasing it from the mechanical arm. The mechanical arm is movable from a horizontal to a vertical position to avoid obstructing the work area. A lock and a remote fluid operating system are preferrably provided for the arm.

7 Claims, 8 Drawing Figures

METHOD AND DEVICE FOR POSITIONING AND GUIDING PIPE IN A DRILLING DERRICK

CROSS-REFERENCE TO RELATED APPLICATIONS

This application is a continuation-in-part of U.S. patent application Ser. No. 931,150 filed Aug. 4, 1978 now abandoned, and U.S. patent application Ser. No. 42,001 filed May 24, 1979 now U.S. Pat. No. 4,274,777.

BACKGROUND OF THE INVENTION

1. Field of the Invention

This invention relates generally to methods and devices for guiding pipe, and more particularly, but not by way of limitation, to improved methods and apparatus for vertically aligning and joining pipe section joints in a derrick.

2. Description of the Prior Art

In the drilling, completion and work-over of oil, gas and water wells, it is necessary to remove and install strings of pipe sections in a well bore. During such operations, a rig or derrick having a work floor or table and an elevator for vertically suspending one or more pipe sections above the work table is utilized. As pipe section joints are lowered into the well, additional pipe section joints are threaded to the upper end of the joint which extends a short distance above the work table. Generally, the pipe section which extends into the well bore is secured so that its upper-most threaded box end remains stationery during the threading process. The additional pipe section is then vertically suspended in the derrick by means of a carrying line, maneuvered, and rotated; threading its lower end to the upper threaded boxed end of the secured pipe joint.

In the past, it has been necessary to position a workman often called a stabber, in the upper sections of the derrick to maneuver the upper end of the to be threaded pipe section so that the maneuvered pipe is in alignment with the secured pipe in the well bore. Generally, this requires that the upper section of pipe rest on the lower section of pipe while the stabber maneuvers the pipe into alignment. After alignment is achieved a gripping device is attached to the lower end of the to be threaded pipe and this pipe is threaded to the pipe joint in the well bore.

A particular problem with this process of combining pipe joints is that the stabbing job is relatively dangerous. It requires a workman to be positioned in a high place in the derrick and to physically handle a heavy section of pipe. More importantly, this process also frequently damages the threads of the pipe as the sections are made up. Damage to the threads can occur either because the sections are not properly aligned when threaded due to errors on the part of the stabber or because the threads were initially misaligned yet connected prior to the stabber moving the pipe to an aligned position (and prior to the threading process). Furthermore, even if the stabber properly aligns the pipe, some pipe joints are sufficiently flexible that they bow during the alignment process. In this case, even if the stabber properly aligns the extreme end of the pipe, the lower threaded end of the pipe will not be properly aligned due to bowing.

Similar problems occur when pipe is being removed from the well. In the past, the derrick elevator has been used to raise pipe until a complete section of pipe is free and a second lower section of the pipe can be secured in the work table. A gripping device is then attached to a lower portion of the free section and this section is unthreaded from the secured section. A line attached to the upper end of the freed and unthreaded section is used to move this section to a stored position.

In this removal and disconnection process the pipe threads are often damaged because the threads of the free section rest on the threaded box end of the secured section as the pipe is canted by the line attached to its upper end and removed to a stored position. Tilting or canting of the free section on the secured section often crosses the threads prior to the separation. As with the joining process, the removal requires a stabber to perform a dangerous job of securing a line to and removing a very heavy piece of pipe.

In the past, various devices have been used for holding the lower end of a pipe section as it is threaded or unthreaded from the upper end of a pipe section secured in the work table. Examples of such devices are shown in U.S. Pat. Nos. 2,692,059; 2,828,024; 2,829,783; and U.S.S.R. Patent No. 309,113. Each of the devices described in these patents and the processes used in positioning pipe with these devices have not been satisfactory. Particularly, these devices still require the use of a pipe stabber located in an upper portion of the derrick and thread damage still occurs due to misalignment of the pipe and cross-threading. Also, these devices are easily damaged and are not suitable for many jobs.

By the present invention an improved pipe guiding and aligning method and apparatus is provided for positioning and guiding the suspended pipe section as they are threaded and unthreaded.

SUMMARY OF THE INVENTION

The present invention provides an improved method and device for positioning pipe in a derrick and coupling and uncoupling a first pipe joint from a second pipe joint.

In the coupling method of the present invention an arm is positioned in the derrick so that a pipe-receiving slot of the arm can receive the upper end of a first pipe joint at a location linearly above a second pipe joint disposed in the work table section of the derrick. The upper end of a first pipe joint is then positioned so that it is received in the pipe-receiving slot of the arm. The slot is then enclosed with a closure member so that the upper end of the pipe positioned in the slot is retained linearly above the second pipe joint. The lower end of the first pipe joint is then positioned above the second pipe joint and the first pipe joint is lowered into contact with the second pipe joint. The two joints are then threaded together coupling the lower end of the first pipe joint to the upper end of the second pipe joint. The slot is then unenclosed by moving the closure member and then the pipe-receiving slot is moved away from the upper end of the first pipe joint.

In the method of uncoupling a first pipe joint from a second pipe joint, the present invention first positions the pipe joints so that the first pipe joint conventionally extends upwardly in the derrick while the second pipe joint is secured in the work table. Next, an arm is positioned in the derrick so that a pipe-receiving slot of the arm receives the upper end of the first pipe joint at a location linearly above the second pipe joint disposed in the work table. The pipe-receiving slot of the arm is then enclosed with a closure member so that the upper end of the pipe positioned in the slot is retained linearly above the second pipe joint. The first pipe joint is then uncoupled from the second pipe joint and raised so that the first pipe joint is not in contact with the second pipe joint. The slot is then unenclosed by moving the closure member and the first pipe joint is moved away to a storage location. The pipe receiving slot of the arm is then moved away so that the second pipe joint can be raised and uncoupled in the same manner as the first pipe joint.

The apparatus of the present invention comprises a frame arm having finger portions extending outwardly from one end thereof forming a slot for receiving a pipe joint therebetween. A rotary axle is connected to the end of the frame arm opposite the finger portions and connected horizontally to the derrick so that when the axle means are rotated the finger portion of the frame swings in a vertical arc. Means are provided for adjusting the position of the pipe-receiving slot so that when the frame arm extends horizontally from the derrick the slot will receive a pipe joint linearly above the work table. Closure means are provided for enclosing the pipe joint which is received in the slot and holding the pipe joint linearly above a second pipe joint disposed in the work table. A first cylinder means is provided for opening and closing the closure means. A second cylinder means is provided for rotating the frame arm about the rotary axle so that the finger portion can be moved in an arc of approximately 90°. Fluid pressure means are provided for actuating the first and second cylinder means.

It is therefore, a general object of the present invention to provide an improved method and apparatus for positioning and guiding pipe in a derrick. Particularly, it is an object to provide such positioning and guiding in connection with the coupling and uncoupling of pipe joints extending into the derrick.

It is a further object of the present invention to provide improved pipe positioning and guiding methods and apparatus which are safer and effectively guide and align pipe sections suspended in the derrick so that threaded engagement and disengagement of the sections can be effected without damage to the threads thereof.

Yet a further object of the present invention is the provision of improved pipe guiding methods and apparatus which positively engage a pipe section at an upper portion such that its lower threads cannot be misaligned by mis-positioning of the upper portion or by bowing of the pipe.

For a further understanding of the invention and further objects, features and advantages thereof, reference may now be had to the following description taken in conjunction with the accompanying drawings.

BRIEF DESCRIPTION OF THE DRAWINGS

FIG. 6 is a side elevational view similar to the view of FIG. 2 of an alternate embodiment of the apparatus of the present invention.

DESCRIPTION OF PREFERRED EMBODIMENTS

Figure 1:
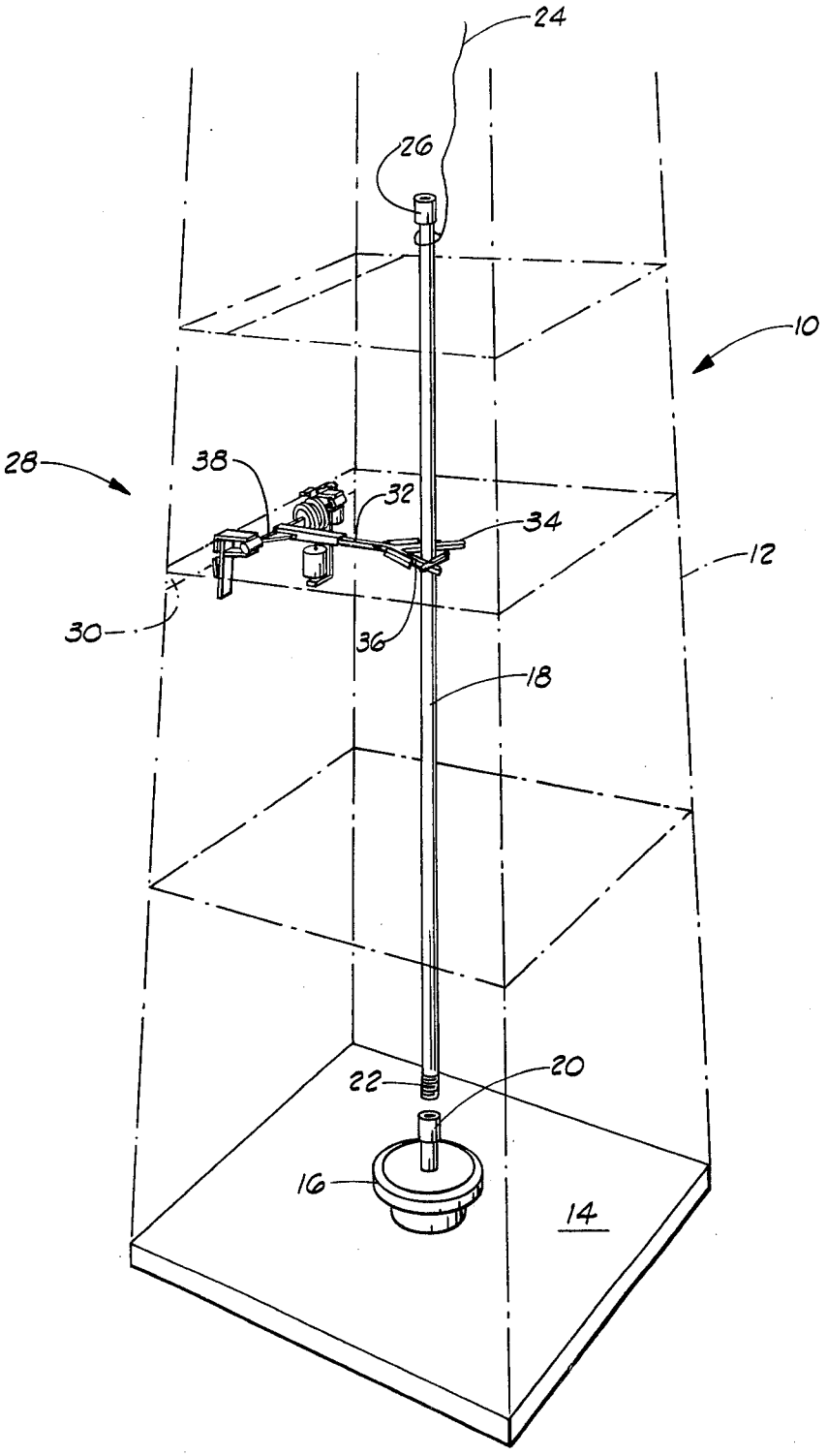
FIG. 1 is a side perspective view of the pipe positioning apparatus of the present invention mounted in a derrick and engaging a pipe section suspended in the derrick above the derrick floor.

FIG. 1 illustrates an oil derrick 10 having a derrick frame 12 of conventional type extending upward from a rig floor 14 having a centrally disposed work table 16. FIG. 1 also illustrates a single pipe section 18 disposed in alignment over a second pipe section 20 disposed in the rotary work table 16. The work table 16 is of conventional construction and includes slips which can be clamped and unclamped about the pipe section 20 to secure the section or joint 20. Disposed above the pipe section 18 and suspended from the derrick frame 12 is a derrick elevator (not shown). The derrick elevator is used to raise and lower heavy sections of pipe as when the threaded lower end 22 is threaded to the threaded box end of pipe section 20 (usually connected to an entire pipe string extending into the well bore).

It is often desirable to maneuver single sections of pipe about the derrick. In this case, a looped cable 24 often called a cat line is looped about the box end 26 of the pipe 28. By maneuvering the cable 24, the pipe joint 18 can be swung about the derrick and positioned in an appropriate location. The cable 24 is conventional and, therefore, equipment for operating the cable is not shown.

In order to position and guide pipes in accordance with the present invention, a device 28 is utilized under remote control. The device 28 is attached to a cross-member or girder of the derrick frame 12. It is extremely important that the device 28 be positioned at a height so that, in operation, the device 28 will contact, guide and support a pipe joint 18 near its upper end. As used in this application, the "upper end or portion" of the pipe joint 18 means that portion of the pipe which is sufficiently high so that alignment of the pipe is facilitated yet not so high that the weight of a pipe so supported will cause the pipe to bow. Generally this will be a portion of the pipe from about its midpoint to very near its upper end.

The device 28 comprises a frame 32 having fingers 34 and 36 extending from the outward end thereof. These fingers form a slot for receiving the pipe joint 18 when the frame arm 32 is horizontally extended from the girder 30. It is important that the slot be precisely located so that the pipe 18 when secured in the slot and its threaded end 22 is engaged with the box end of section 20, will be precisely aligned with pipe section 20.

A rotary axle 38 is attached to the end of frame arm 32 opposite fingers 34 and 36. The rotary axle 38 is mounted horizontally adjacent and parallel to girder 30. Frame arm 32 extends transversely from the rotary axle 38 so that the fingers 34 and 36 can move in approximately a 90° arc about the axle 38 from a downward position to a position horizontally outward from girder 30. In the horizontal position, the fingers 34 and 36 are ready for receiving the pipe joint 18 to secure, guide and align the pipe.

Figure 2:
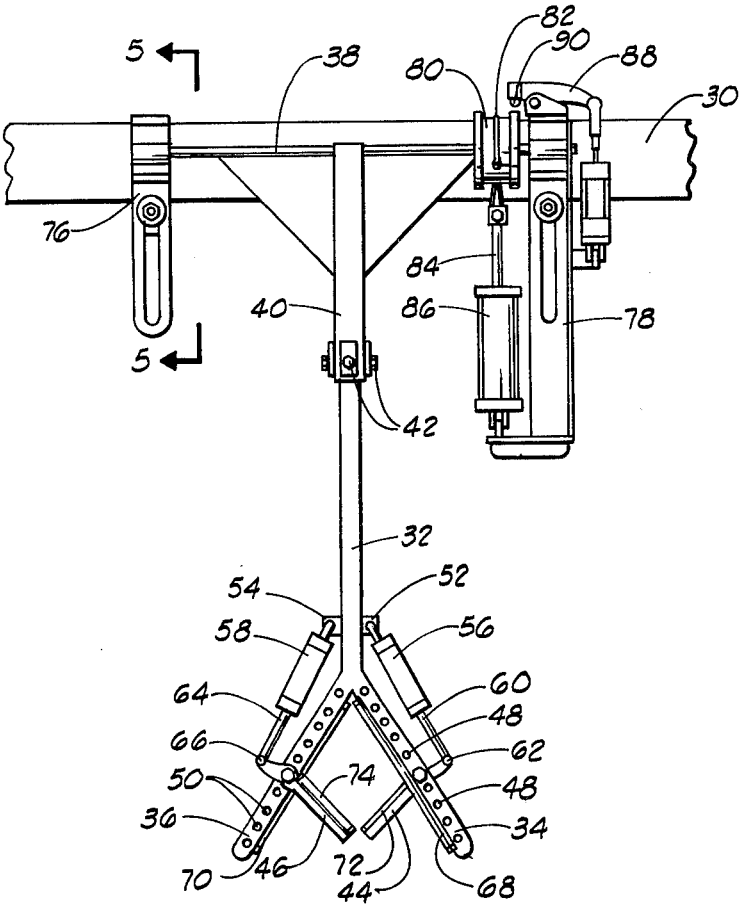
FIG. 2 is a side elevational view of the apparatus of FIG. 1 with the arm in a lowered position.

FIG. 2 illustrates the device 28 in greater detail. The frame arm 32 of the device 28 is telescopingly received into a hollow arm 40, one end of which is welded to rotary axle 38. Triangular supports extend from the sides of hollow member 40 to axle 38 to secure the connection. Bolts 42 are provided at the end of hollow member 40 to secure frame arm 32 at a variable position outwardly from axle 38. In this manner, the location at which fingers 34 and 36 engage and secure a pipe received therebetween can be adjusted.

Attached to fingers 34 and 36 are closure bars 44 and 46, respectively. The bars 44 and 46 are secured at a variable position along the arms 34 and 36. Bolts extend through a mid portion of the bars 44 and 46, and through the holes 48 and 50 spaced along fingers 34 and 36, respectively. This allows the closure bars 44 and 46 to secure pipes of varying size.

Closure bars 44 and 46 pivot about the bolts which attach the bars to arms 34 and 36. To regulate the movement of the bars 34 and 36 cylinders 56 and 58 are provided. Cylinder 56 has its rear end attached to a flange 52 extending from the side of frame arm 32. Cylinder 58 has its rear end attached to a flange 54 extending from the opposite side of frame arm 32. The piston arm 60 of cylinder 56 has its outer end pivotally attached to the end 62 of closure bar 44. Piston arm 64 of cylinder 58 has its outer end attached to the end 66 of the closure bar 46.

In operation, cylinders 56 and 58 open and close the closure bars 44 and 46 about a pipe secured in the pipe-receiving area between fingers 34 and 36. Rollers 68 and 70 are provided along the inner edge of fingers 34 and 36 to allow a pipe secured in this area to move transversely to the fingers relatively freely. Likewise, rollers 72 and 74 are provided along the inner edge of closure bars 44 and 46 to allow a secured pipe to move relatively easily transversely to the closure bars 44 and 46.

As described above, the frame arm 32 is designed for movement in a 90° arc from a downward position from girder 30 to a horizontally outward position from girder 30. The ends of the rotary axle 38 are journaled to girder attachment assemblies 76 and 78. These assemblies allow an adaptable attachment to girder 30. Assembly 78 also provides a support for the mechanism which raises and lowers the frame arm 32 and the mechanism which locks the arm in a horizontal position at an appropriate time.

To allow the frame arm 32 to be moved in its 90° arc, a drum 80 is fixedly attached to rotary axle 38 adjacent the attachment assembly 78. A cable 82 is wound about drum 80 with one end fixedly attached to the drum 80. The opposite end of cable 80 is attached to the cylinder arm 84 of cylinder 86. Cylinder 86 is secured to attachment assembly 78 so that movement of the arm 84 rotates the drum 80 and moves frame arm 32 in an arc.

Because the frame arm 32 is moved in an arc by fluid pressure supplied to cylinder 86, it is desirable to provide a locking mechanism for holding the arm 32 in a horizontal position as the fingers 34 and 36 engage and guide a pipe joint 18. To provide this locking action a rocker arm 88 has its midportion pivotally attached to the upper end of attachment assembly 78. A ball bearing 90 is rotatably secured in an end of rocker arm 88 above a rim portion of the drum 80. A hemispherical cavity 92 is provided in the rim of drum 80 at a location so that when arm 32 extends horizontally outwardly to secure pipe joint 18, ball bearing 90 can be received in the cavity 92 to lock the drum 80, axle 38 and arm 32 in position. It is desirable to size cavity 92 and ball bearing 90 so that a predetermined large force exerted on the outward end of arm 32 can dislodge the ball bearing 90 from cavity 92 and unlock the arm without causing damage to the arm or the locking mechanism.

Figure 4:
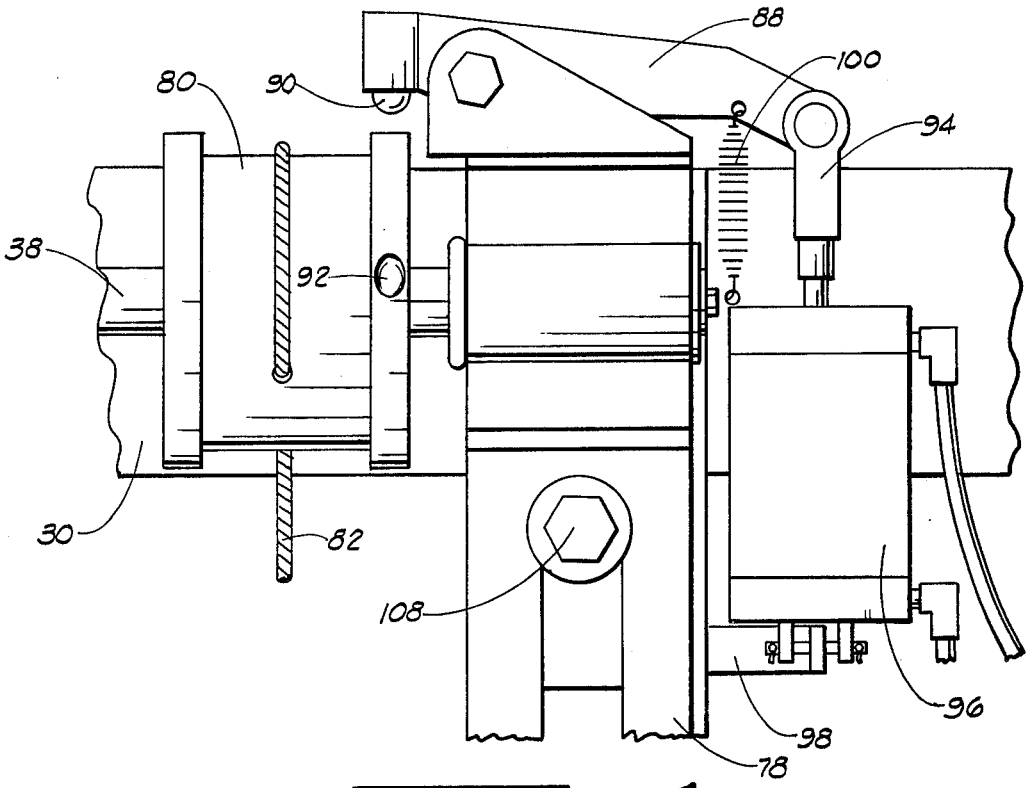
FIG. 4 is a partial side elevational view of a portion of the device shown in FIG. 2.

Referring now to FIG. 4 as well as FIG. 2, the locking mechanism is shown in greater detail. The end of locking arm 88 opposite bearing 90 is attached to the cylinder arm 94 of a pneumatic cylinder 96. This cylinder 96 is secured to a flange 98 extending from attachment assembly 78. A spring 100 is attached to upper arm 88 adjacent cylinder arm 94 to urge the rocker arm 88 into an open position and to assist cylinder 96.

Figure 5:
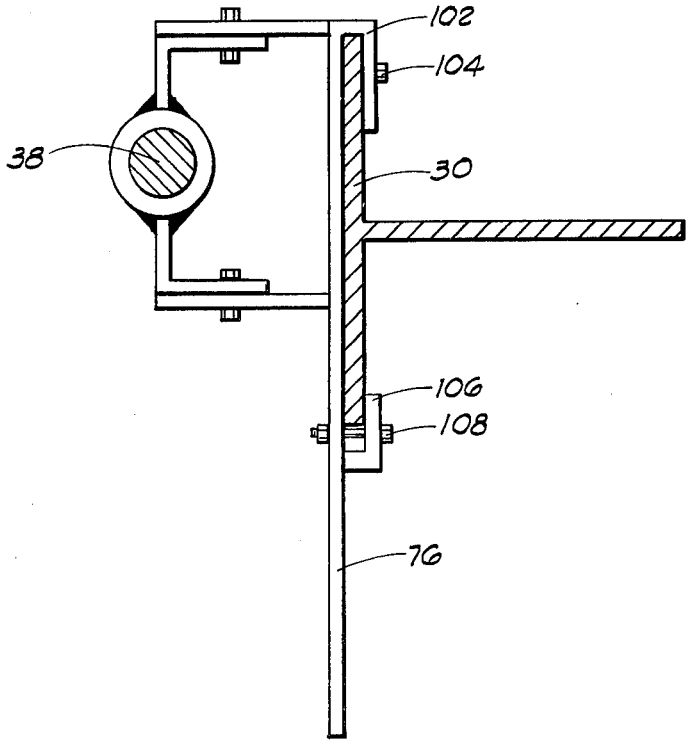
FIG. 5 is a cross-sectional view of the device shown in FIG. 2 taken along the lines shown in FIG. 2.

FIG. 5 illustrates the attachment assembly 76. The upper end of attachment assembly 76 comprises a downwardly facing channel 102. This channel 102 receives the vertically extending portion of girder 30 to horizontally support rotary axle 38. A cup-headed set screw 104 is threaded through channel 102 to engage the girder 30 and retain the attachment assembly 76 in position on the girder. The lower end of attachment assembly 76 is connected to the lower end of girder 30 by an L-shaped flange 106. This L-shaped flange 106 adjustably moves in a vertically extending slot in attachment assembly 76. The flange 106 can thus be positioned over the lower end of girder 30 and secured by a bolt 108 extending through the slot in assembly 76.

Figure 7:
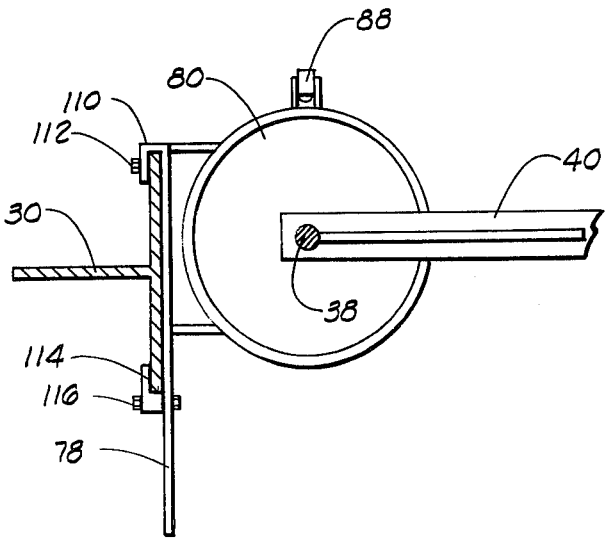
FIG. 7 is a partial cross-sectional view of the apparatus shown in FIG. 1.
Figure 8:
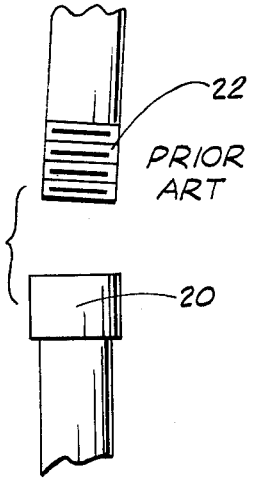

FIG. 7 illustrates attachment assembly 78. Like assembly 76 assembly 78 includes a channel 110 which receives the upper end of girder 30. A cup-headed set screw 112 adjustably attaches the assembly 78 to girder 30. An L-shaped flange 114 is connected to assembly 78 by a bolt 116. The flange 114 is adjustably received in a vertical slot in assembly 78 to connect assembly 78 to the lower end of girder 30. For clarity, cylinders 86 and 96 are not shown in FIG. 7 although they would normally appear.

Figure 3:
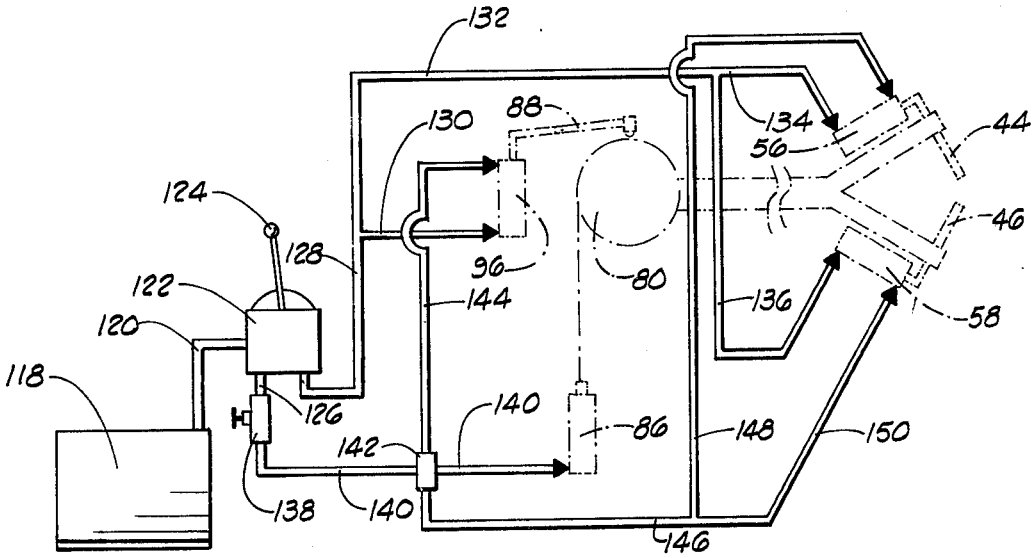
FIG. 3 is a schematic view of the cylinders and arms shown in FIGS. 1 and 2 together with a schematic view of the pressurized fluid lines of the present invention.

Referring now to FIG. 3, the operating mechanism and fluid lines of the present invention are shown schematically. Each of the cylinders 56, 58, 86 and 96 are pneumatically operated by pressurized air from a reservoir 118. Of course, the cylinders could be hydraulicly or pneumatically operated.

Reservoir 118 is connected to a manual control box 122 by a supply line 120. The control box 122 has a manual control lever 124. The position of lever 124 alters the charge or relief condition of pressurized air in the conduits 126 and 128.

Preferrably, control box 122 is located on the derrick floor adjacent the controls for cable 24. In this way, operation of the device 28 can be coordinated by a single operator with the controls for cable 24.

Conduit 128 connects control box 122 to conduits 130 and 132. Conduit 130 is connected to the locking mechanism cylinder 96 so that pressure supplied through the conduit 130 urges cylinder 96 to move rocker arm 88 into a locking position. Conduit 132 connects conduit 128 to conduits 134 and 136. Conduits 134 and 136 are in turn, connected to the closure bar cylinders 56 and 58. The connection is such that when pressurized air is supplied through conduits 134 and 136 cylinders 56 and 58 urge closure bars 44 and 46 into a closed position.

Conduit 126 connects control box 122 to a pressure regulation valve 138. The valve 138 is adjustable to vary the amount of time required to supply pressure to conduit 140 which is connected to valve 138. Conduit 140 is directly connected to the drum operation cylinder 86 so that the supply of pressurized air to conduit 140 urges cylinder 86 to rotate drum 80 and frame arm 32 from a downward position to a horizontal position.

Connected to conduit 140 is a reducing valve 142. The reducing valve 142 reduces the pressure supplied from conduit 140 to conduits 144 and 146. Conduit 144 is connected to lock cylinder 96 so that pressurized air supplied through conduit 144 urges cylinder 96 to open or unlock rocker arm 88.

Conduit 146 connects reducing valve 142 to conduits 148 and 150. Conduits 148 and 150 are, in turn, connected to closure bar cylinders 56 and 58, respectively. The connection is such that pressurized fluids supplied through conduits 148 and 150 urge cylinders 56 and 58, respectively open.

In operation, the control box 122 has three settings, controlled by control lever 124. In position one, both conduit 126 and 128 are vented. In position two, conduit 126 is charged and conduit 128 is vented. In position three, conduit 128 as well as conduit 126 is charged.

In position one, both conduits 126 and 128 are vented. Accordingly, all of the conduits connected to cylinders 56, 58, 86, and 96 are vented. In this position, the locking mechanism and locking arm 88 are open. The weight of frame arm 32 maintains arm 32 in a downward position. Closure bars 44 and 46 are not urged either direction but should be open because the last position prior to position one is position two which urges the closure bars 44 and 46 open. In position one, therefore, the frame arm 32 is unlocked and pointed downwardly while closure bars 34 and 36 are open.

In position two, conduit 126 is charged while conduit 128 is vented. Pressure regulation valve 138 varies the speed at which the charging of conduit 126 also charges conduit 140. As conduit 140 is charged pressurized air enters cylinder 86 which rotates drum 80 and raises frame arm 32 to a horizontal position. At the same time, pressurized air enters conduits 144 and 146 through reducing valve 142. Thus, pressurized air of a reduced pressure enters locking cylinder 96 through conduit 144. This urges rocker arm 88 into an open position. Conduit 146 supplies reduced pressured air to conduits 148 and 150 urging closure bars 44 and 46 into an open position. In position two, therefore, frame arm 32 is moved to an unlocked horizontal position and closure bars 44 and 46 are held open.

In position three, conduits 128 and 126 are both charged. As conduit 128 is charged pressurized fluid is supplied through conduit 130 to locking cylinder 96. Since the pressurized air in conduit 130 is of a higher pressure than the air in conduit 144 due to reducing valve 142, the charging of conduit 130 overcomes the air supplied in conduit 144 to close the locking mechanism by moving rocker arm 88 to a closed position. In this position, ball bearing 90 is seated in the hemispherical cavity 92. Cavity 92 is appropriately located because frame arm 32 is horizontally positioned due to the air pressure charged to cylinder 86 through conduit 140. Charging conduit 126 also charges conduits 134 and 136 urging closure bar cylinders 56 and 58 to overcome the reduced pressure supplied through conduits 148 and 150. This closes closure bars 44 and 46. In position three, therefore, frame arm 32 is extended horizontally and held locked in this position while closure bars 44 and 46 are moved to a closed position.

Reducing valve 142 is adjustable to vary the amount of pressure reduction in the air supplied through conduits 144 and 146. In this manner, the amount of force applied to rocker arm 88 and closure bars 44 and 46 is varied. This is desirable to change the amount of pressure required to break the lock or to exert on the pipe secured between fingers 34 and 36.

Typically, 120 lb. pressure air will be supplied through reservoir 118 to conduits 126 and 128. Reducing valve 142 will typically be set to supply 80 lb. pressure air to conduits 144 and 146. Therefore, in position three, rocker arm 88 as well as closure bars 44 and 46 are urged closed with forty pounds of pressure.

In the method of the present invention the device 28 is utilized in positioning, guiding, threading and unthreading pipe joints with respect to the pipe section 20 secured in the work table 16. Accordingly, the attachment assemblies 76 and 78 and frame arm 32 must be adjusted into precise alignment so that a pipe joint received between fingers 34 and 36 and secured by closure bars 44 and 46 will be precisely aligned with the section in the work table 16.

In the threading or coupling method of the present invention a pipe section 20 is secured in the work table 16 so that its box end extends above the work table and is held secure in this position. At this time, control lever 124 is in position one so that frame arm 32 is unlocked and pointed downwardly. Closure bars 44 and 46 are open.

Next, control lever 124 is moved to position two raising frame arm 32 to a horizontal yet unlocked position. Closure bars 44 and 46 remain open. Cable 24 is then looped about the box end 26 of a pipe section 18. This pipe section is maneuvered by cable 24 into position vertically above pipe section 20. As the pipe section 18 is swung into position, it encounters and is received between fingers 34 and 36. At this time, the pipe section 18 is not yet lowered into contact with pipe section 20.

As pipe section 18 is received between fingers 34 and 36, lever 124 is moved to position three. This closes closure bars 44 and 46 and locks arm 32 in a horizontal position. In this way, pipe section 18 is secured against horizontal or radial movement and yet allows the pipe to move in a vertical direction. The rollers 68, 70, 72 and 74 reduce friction opposing the vertical movement of the enclosed pipe section 18. Following the enclosure of pipe section 18 by closure bars 44 and 46, the controls of cable 24 are operated to allow the pipe section 18 to move vertically toward pipe section 20. The lower end of pipe section 18 is carefully maneuvered so that the threads 22 encounter the box end of pipe section 20. After contact is made, the pipe section 18 is precisely aligned with pipe section 20. The device 28 secures the upper portion of pipe section 18 and maintains this alignment while preventing the pipe from bowing. After the threads 22 encounter the box end of pipe section 20, a conventional gripping device is placed about the lower end of pipe section 18 and the two sections 18 and 22 are threaded together.

After the sections 18 and 20 are threaded together, lever 124 is moved back to position two. This opens closure bars 44 and 46 and unlocks the locking mechanism and rocker arm 88. Next, lever 124 is moved to position one lowering frame arm 32. The frame arm must be moved so that fingers 34 and 36 will not impede the box end 26 of pipe joint 18 or the derrick elevators attached thereto as the pipe section is lowered into the ground.

The operations of removing cable 24 from pipe section 18, connecting the derrick elevators to pipe section 18, and disconnecting the work table 16 from pipe joint 20 all are conventional. With the above explanation concerning the use of device 28, the timing of these events will be obvious to those skilled in the art.

In the method of uncoupling and unthreading of coupled pipe joints 18 and 20 of the present invention, the derrick elevators are first used to raise the pipe sections until the upper end of pipe joint 20 extends above work table 16 and pipe joint 18 extends further into the derrick. The work table 16 is then secured about pipe joint 20 to secure the upper end of pipe section 20. With pipe section 18 in this position, control lever 124 is moved from position one to position two causing frame arm 32 to move outwardly to a horizontal position. The upper end of pipe section 18 is received between fingers 34 and 36. Control lever 124 is then moved to position three closing closure bars 44 and 46 and locking frame arm 32 in a horizontal position.

With pipe section 18 secured vertically above pipe section 20 by device 28, pipe section 18 is unthreaded from pipe section 20. The pipe section 18 is then raised so that its lower threads 22 do not contact pipe section 20. Lever 124 is then moved to position two causing closure bars 44 and 46 to open. Pipe section 18 is then swung or moved to a storage position.

After pipe section 18 has been removed lever 124 is moved to position one lowering frame arm 32. This removes fingers 34 and 36 from the work area through which the derrick elevators will travel in moving a new pipe into position.

The removal of the derrick elevators, the coupling of the looped cable 24 and the operation of the work table 16 are conventional. The timing of these events will be obvious to those skilled in the art in view of the description above concerning the operation of device 28 in uncoupling and unthreading the pipe joint 18.

Figure 8:
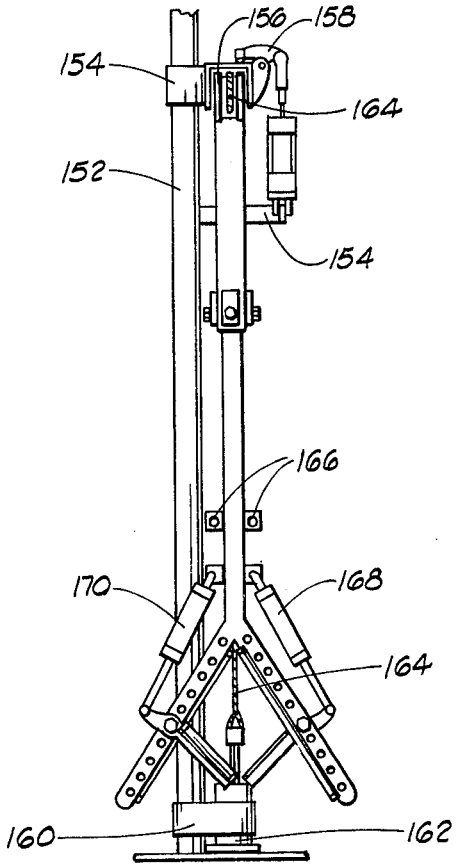
FIG. 8 is a side elevational view of misaligned pipe joints of the prior art.

Referring now to FIG. 8, it can be seen that the coupling and uncoupling methods of the present invention described above prevent misalignment of pipe which occurred in the prior art. Accordingly, the threads 22 are not misaligned or crossed with the threads in the box end of pipe section 20. Therefore, the method of the present invention prevents damage to the threads, eliminates the dangerous and difficult job of single-handedly stabbing the pipe from high in the derrick, and automatically aligns and secures the upper end of the pipe to prevent misalignment and bowing.

Referring now to FIG. 6, an alternate embodiment of the present invention is shown for use where the derrick frame does not have a suitable girder 30. In this case, the device can be attached to a vertical pipe 152 of the derrick 12. Attachment assemblies 76 and 78 are replaced with an upper collar 154 and a lower collar 160. The upper collar 154 is securely attached about the vertical pipe 152. The upper end of the frame arm is journaled to the collar 154. A drum 156 is disposed across the journaled attachment. A rocker arm 158 is pivotally attached to the collar 154 and operates in the same manner as the locking mechanism and rocker arm 88.

A drum rotation cylinder 162 is fixedly connected to collar 160 attached to pipe 152 beneath collar 154. This cylinder 162 is connected to cable 164 and operates equivalently to the cylinder 86.

Other than the manner of attaching the device to the derrick frame, the device shown in FIG. 6 operates in the same manner as the device shown in FIG. 2.

FIG. 6 also illustrates a means for varying the attachment of the closure bar cylinders. An alternate pair of flanges 166 is provided for attaching cylinders 168 and 170 to the frame arm. This allows the closure bars to attached to the fingers on the end of the frame arm over a wider spacing.

Thus, the method and apparatus for positioning and guiding pipe in a drilling derrick of the present invention are well adapted to attain the objects and advantages mentioned as well as those inherent therein. While presently preferred embodiments of the invention have been described for the purpose of this disclosure, numerous changes in the details of method steps and in the construction and arrangement of parts can be made by those skilled in the art which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A method of coupling a first pipe joint to a second pipe joint in a drilling derrick having a work table, comprising the steps of:

positioning by moving in a vertical arc a mechanical arm in the derrick so that a pipe-receiving slot of the arm can receive the upper end of a first pipe joint at a location linearly above a second pipe joint disposed in the work table section of the derrick;

locking said mechanical arm such that said pipe-receiving slot is immobile in a position linearly above said second pipe joint;

swinging the upper end of a pipe joint so that it is received in the pipe-receiving slot of the arm;

enclosing the slot with a closure member so that the upper end of the pipe positioned in the slot is retained linearly above the second pipe joint;

swinging the lower end of the first pipe joint adjacent to the second pipe joint;

coupling the lower end of the first pipe joint to the upper end of the second pipe joint;

opening the slot by moving the closure member; and moving the pipe receiving slot of the arm away from the upper end of the first pipe joint.

2. A method of uncoupling a first pipe joint from a second pipe joint disposed in a drilling derrick having a work table, comprising the steps of:

raising a first pipe joint coupled to a second pipe joint until the second pipe joint is disposed in the work table section of the derrick and the first pipe joint extends linearly above the second pipe joint in the derrick;

positioning by moving in a vertical arc a mechanical arm in the derrick so that a pipe-receiving slot of the arm receives the upper end of the first pipe joint;

locking said mechanical arm such that said pipe-receiving slot is immobile in a position linearly above said second pipe joint;

enclosing the slot with a closure member so that the upper end of the pipe joint positioned in the slot is retained linearly above the second pipe joint;

uncoupling the lower end of the first pipe joint from the upper end of the second pipe joint;

opening the slot by removing the closure member;

swinging the first pipe joint away from the second pipe joint and the pipe-receiving slot of the arm; and moving the pipe-receiving slot of the arm away from the position linearly above the second pipe joint.

3. A method of positioning a first pipe section in a drilling derrick and then threading that first pipe section to a second pipe section secured in a work table of the derrick, comprising the steps of:

positioning by moving in a vertical arc a mechanical arm in the derrick so that a pipe-receiving slot of the arm can receive the upper end of the first pipe section at a location above the work table and in alignment with the second pipe section;

locking said mechanical arm such that said pipe-receiving slot is immobile in a position linearly above said second pipe joint;

moving the upper end of the first pipe section so that it is received the pipe-receiving slot of the arm;

enclosing the slot with a closure member so that the upper end of the first pipe section is retained linearly above the second pipe section;

moving the lower end threads of the first pipe section into contact with the upper end threads of the second pipe section, threading the first pipe section to the second pipe section;

opening the slot by moving the closure member; and moving the pipe-receiving slot of the arm away from the upper end of the first pipe section.

4. A method of unthreading a first pipe joint threaded to and extending up from a second pipe joint secured in a work table fo a drilling derrick and moving the first pipe section to a storage position comprising the steps of:

positioning by moving in a vertical arc a mechanical arm in the derrick so that a pipe-receiving slot of the arm receives the upper end of the first pipe section;

locking said mechanical arm such that said pipe-receiving slot is immobile in a position linearly above said second pipe joint;

enclosing the slot with a closure member so that the upper end of the pipe positioned in the slot is retained linearly above the second pipe section;

unthreading the lower end threads of the first pipe section from the upper end threads of the second pipe section;

raising the first pipe section;

opening the slot by removing the closure member;

moving the first pipe section away from the second pipe section and the pipe-receiving slot of the arm; and moving the pipe-receiving slot of the arm away from the position linearly above the second pipe section.

5. A pipe positioning and holding device for use in combination with a drilling derrick having a work table to secure pipe sections and a derrick structure extending above the work table for holding equipment used in raising and lowering pipe with respect to the work table, comprising:

a frame arm having finger portions extending outwardly from one end thereof forming a slot for receiving a pipe joint therebetween;

a rotary axle means connected to said frame arm opposite said finger portion;

connection means for horizontal attachment of the rotary axle means to the derrick structure such that when said axle means are rotated the finger portion of said frame arm swings in a vertical arc;

means for adjusting the position of said slot such that when said frame arm extends horizontally from the derrick structure said slot will receive the upper end of a pipe joint linearly above said work table;

closure means for enclosing a pipe joint received in said slot;

first cylinder means for opening and closing said closure means;

second cylinder means for rotating said frame arm about said rotary axle so that said finger portion can be moved in an arc of approximately 90°;

fluid pressure means for actuating said first and second cylinder means;

lock means for locking said frame arm in a horizontally extending position; and third cylinder means for selectively locking and unlocking said lock means.

6. The device of claim 5 wherein said pressurized fluid supply means is connected to supply pressurized fluid to actuate said lock means.

7. A pipe positioning and holding device for use in combination with a drilling derrick having a work table to secure pipe sections and a derrick structure extending above the work table for holding equipment used in raising and lowering pipe with respect to the work table, comprising:

a frame arm having finger portions extending outwardly from one end thereof forming a slot for receiving a pipe joint therebetween;

a rotary axle means connected to said frame arm opposite said finger portion;

connection means for horizontal attachment of the rotary axle means to the derrick structure such that when said axle means are rotated the finger portion of said frame arm swings in a vertical arc;

means for adjusting the position of said slot such that when said frame arm extends horizontally from the derrick structure said slot will receive the upper end of a pipe joint linearly above said work table;

closure means for enclosing a pipe joint received in said slot;

first cylinder means for opening and closing said closure means;

second cylinder means for rotating said frame arm about said rotary axle so that said finger portion can be moved in an arc of approximately 90°;

fluid pressure means for actuating said first and second cylinder means, including; first, second and third conduits;

said first conduit selectively carrying pressurized fluid to said second cylinder means to urge said second cylinder means to raise said frame arm;

said second conduit selectively carrying pressurized fluid to said first cylinder means for urging said first cylinder means to clsoe said closure means;

said third conduit means selectively carrying fluid to said first cylinder means to urge said closure means open; and selective pressurized fluid supply means for selectively supplying pressurized fluid to said first, second and third conduits in first, second and third states;

said first state comprising not supplying pressurized fluid to said first, second and third conduits;

said second state comprising supplying pressurized fluid to said first conduit at a first pressure, not supplying pressurized fluid to said second conduit, and supplying pressurized fluid at a second pressure to said third conduit means; and said third state comprising supplying pressurized fluid to said first conduit at said first pressure, supplying pressurized fluid to said second conduit at a third pressure higher than said second pressure, and supplying pressurized fluid to said third conduit at said second pressure.

* * * * *